US005487620A

United States Patent [19]

Holman

[11] Patent Number: 5,487,620

[45] Date of Patent: Jan. 30, 1996

[54] DRAINING PAVEMENT ELEMENT, METHOD FOR MANUFACTURING IT AND PAVEMENT MADE WITH IT

[75] Inventor: Harm W. Holman, Doesburg, Netherlands

[73] Assignees: Terra IJssel B.V., Lathum; Harm Willem Holman, Doesburg, both of Netherlands

[21] Appl. No.: 266,550

[22] Filed: Jun. 28, 1994

[30] Foreign Application Priority Data

Jun. 30, 1993 [NL] Netherlands ..... 9301143

[51] Int. Cl.[6] ..... E01C 5/00; E01C 9/00

[52] U.S. Cl. ..... 404/31; 404/44

[58] Field of Search ..... 404/27, 29, 30, 404/31, 40, 43, 44

[56] References Cited

U.S. PATENT DOCUMENTS

| | | | |
|---|---|---|---|
| 3,687,021 | 8/1972 | Hensley | 404/31 |
| 3,801,421 | 4/1974 | Allen et al. | 404/32 X |
| 3,910,710 | 10/1975 | Gagle et al. | 404/31 X |
| 4,572,700 | 2/1976 | Mantarro et al. | 404/35 |
| 4,662,778 | 5/1987 | Dempsey | 404/44 X |
| 5,281,048 | 1/1994 | Hagenah . | |

FOREIGN PATENT DOCUMENTS

| | | |
|---|---|---|
| 0053092 | 6/1982 | European Pat. Off. . |
| 2436081 | 2/1976 | Germany . |
| 3909169 | 10/1989 | Germany . |
| 9201491 | 7/1992 | Germany . |
| 7213263 | 4/1974 | Netherlands . |
| 8200289 | 8/1983 | Netherlands . |
| 8402658 | 3/1986 | Netherlands . |
| WO92/20864 | 11/1992 | WIPO . |

*Primary Examiner*—William P. Neuder
*Attorney, Agent, or Firm*—Larson and Taylor

[57] ABSTRACT

Pavement element such as a tile with an upper porous layer (2), below that a liquid-tight layer (3) and possibly there below a heavy layer (4). In order to keep a floor laid with suchlike elements well liquid-tight at the level of the liquid-tight layers sealing means (6) are provided between this layer (3) or one element and the same layer (3') of an adjacent element. Preferably these means consist in a rib or protrusion, which may cover the complete height of the liquid-tight layer. Preferably the porous layer is formed from particles of the same size having an irregular shape and the liquid-tight layer from particle from different particle sizes, such that the particles attain a high filling degree.

22 Claims, 1 Drawing Sheet

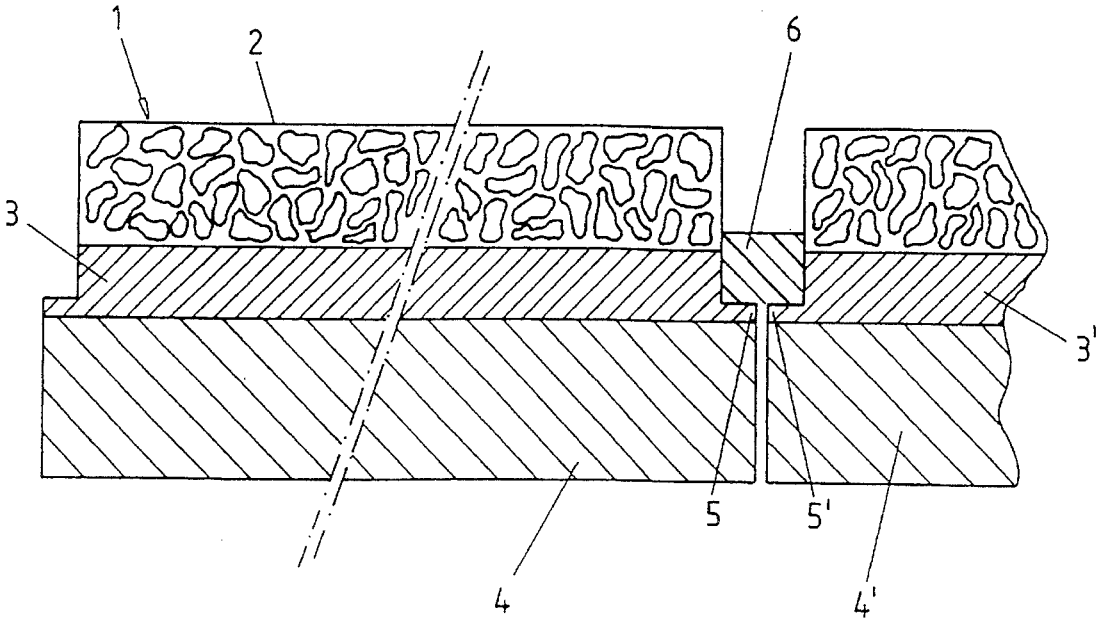
1
2
6
3
3'
5
5'
4
4'

DRAINING PAVEMENT ELEMENT, METHOD FOR MANUFACTURING IT AND PAVEMENT MADE WITH IT

The invention relates to the problem to apply a ground covering layer or pavement, which with a high degree of security prevents that spilled polluted liquids, such as petroleum products, chemical substances, poisonous materials etc. reach the soil below it, and allows for a high discharge of liquid, for instance rainwater.

In the Dutch patent application NL-A-7213263 a self draining layer has been described as well as a method for making it. This layer consists in an upper layer of porous material and a lower layer below it, which is impervious to liquids. Draining tubes may be arranged between both layers to remove liquid which remains on the lower layer. The issue is, that undesired substances, such as spilled fuel oil, easy inflammable liquids, poisonous liquids, biting liquids and/or harmful liquids are retained without penetrating into the ground. Another important property is the possibility to keep water away from surfaces on which vehicles or airplanes run and to prevent aqua-planning. A difficulty of such a ground cover is, that the several layers have to be densified, which often is impossible. Also with dumping of materials and binding agent it is not always possible to obtain sufficient coverage of the material particles with the binding agent when manufacturing the layer in situ.

Hindrances making the manufacturing and densifying of complete layers difficult or hardly possible are for instances car fuel pumps in the immediate surroundings, the application of the prescribed catching means below tanks for polluting liquids and the application of such an impervious layer in buildings, especially on a higher floor.

The invention aims to eliminate these disadvantages. Moreover it aims at making a liquid permeable as well as a liquid-tight layer with less binding agent.

A ground covering element such as a brick or tile, provided with an upper surface, there below at least two layers and a bottom surface is per se known from among others the Dutch patent applications NL-A-8402658 and NL-A-8200289, whereas also the European patent application EP-A-0.053.092 show such a ground covering element. None of these ground covering elements provides, however, a possibility to solve the problems stated in the above.

Dutch patent application NL-A-8200289 describes a tile with a lower layer which has almost the composition of an normal concrete tile, whereas the upper layer contains a granulate mineral material allowing for colour adaption.

Dutch patent application NL-A-8402658 shows a ground cover element in the shape of a multi-sided pavement tile of concrete, to which a sufficient quantity of artificial resin has been added to make the tile itself liquid-tight. There is, however, no liquid discharge possible through the tile, though a convex surface may cause discharge toward the joint between two tiles.

The mentioned European patent application EP-A-0.053.092 shows a tile with at its upper side a layer of natural stone. Also herewith no water discharge through the tile or catching of liquids can be obtained.

To solve these problems the invention provides a pavement element, characterized in that the upper layer is liquid permeable, that the lower layer is impervious to liquid and that at the level of the lower layer sealing means are present to join the lower layers of adjacent elements in a liquid tight way.

The said means to connect to lower layers of adjacent elements can be realized in different ways, such as a preferably somewhat elastic-protruding ridge, a casing enclosing one or more elements and/or filling by pouring the joint between two elements.

According to a preferred embodiment, which easily can be removed from a mould, it is provided that the sealing means contain an extension of the lower layer. It has appeared that herewith a very good seal of the lower layers of different pavement elements can be obtained, if the joint, at least at the level of the lower layer or immediately there above is filled with a liquid-tight sealing means, which preferably is the same plastic as the binding agent for the pavement elements contained in the lower layer or is compatible therewith. The latter is per se known from NL-A-8402658.

For sufficient liquid permeability of the upper layer it is preferably provided that its porosity is at least 15 vol. %. However, in practice porosities of 20 to 40 vol. % are possible. By reason hereof a very good drainage is obtained, even with relatively thin porous layers.

In order to obtain a high porosity preferably particles are used the sizes of which differ little. Therewith often a still higher porosity can be obtained if it is provided that the particles have an irregular shape with a largest diameter which is at least twice the smallest diameter. A good example hereof is formed by scales having non parallel main surfaces.

In order to obtain a mechanical strong liquid impervious layer, which contains relatively little binding agent, it can be provided that this layer contains particles of strongly differing sizes giving a filling degree of more than 90 vol. %. This is attained by mixing a plurality of fractions of differing sizes in such a way that an optimal filling degree is obtained. To obtain such a layer it is preferred to vibrate the mixture and to choose a binding agent, which easily wets the particles, so that the interstices between the particles are completely filled with binding agent.

Because with different applications of pavement elements according to the invention resistance against among others petroleum products is desired it is preferably provided that the binding agent is a plastic which is resistant to petroleum products.

Another problem of such a pavement element or suchlike is, that the seal for liquids can be broken if the element is loosened, for instance by traffic riding over it. It has appeared that the chance that this will occur in a high degree is dependent on the weight of the pavement element. Probably it happens, once movement occurs and part of the element is lifted, that this movement by running over the element will be amplified. If, however, the beginning of movement stays away the whole will remains stabile.

According a further elaboration of the invention it is provided that below the lower layer a base layer is present with a high specific gravity. In this way not only a stabilisation is obtained but moreover it is possible to work-up heavy, possibly polluted waste material, especially if in the base layer it is contained in a non-leaching plastic. Preferably in this layer of high specific weight it is provided that a high filling degree is combined with a high specific weight of the particles.

A binding agent which is non-leaching, neither for water nor for possible other substances, has always the advantage that particles can be used which contain themselves substances, which may not attain the soil.

The invention encompasses also a floor laid with the inventive elements.

The invention encompasses further a method for manufacturing the inventive pavement elements.

Manufacturing in moulds, possibly with vibration is far easier than manufacturing in situ to obtain high densities, as are possible with vibration. Also with manufacturing in a mould it is easier to envelope particles of the porous layer with a thin cover of binding agent and leave the interspace between the particles free. If such particles are not spherical, but for instance plane scales and with vibrating the scales are not brought into parallelism a very firm as well as a very porous unit is made.

The invention does not only provide the advantage that the elements can be manufactured in a mould, which can be vibrated and/or tempered to the right temperature, but also that each of the layers can be made in its own mould, that is to say under the conditions which are most favourable for the considered layer. Thereafter the layers can be connected to each other, preferably by laying them on top of each other and/or to press them before their binding agent is cured.

Of course therewith it should be seen to it that the binding agents used for the different layers polymerise with each other.

In the following the invention is elucidated on hand of the drawing, in which an embodiment of the inventive pavement element and part of an adjacent element have been shown.

In the drawing reference 1 indicates a porous upper layer. This can consist in relatively large particles of about the same size and preferably a shape deviating from a sphere. If suchlike particles are enveloped with a binding agent and this binding agent is cured, they will form a stabile structure. If one uses as little binding agent as possible the pores still will be open and the pores will be connected to each other, so that a ready removal of liquid falling on the upper side 2 of the tile is obtained, which liquid immediately seeps down through the layer 1. Below the layer 1 lays the liquid impervious layer 3, which preferably consists in a plurality of fractions of particles, which in each fraction have a different size, wherewith preferably the size of the smallest particles is very small in comparison with that of the larger or largest ones (for instance 100 to 1000 times smaller). Such a whole gives a high filling degree, which means that the volume of the particles approximates the total volume of the layer. In practice it is not difficult to come to a filling degree of 92 vol. % and even higher is possible. If the binding agent for instance an artificial resin, which has been added together with a curing agent penetrates into the pores and then cures, a whole is formed which is completely liquid-tight and needs only little plastic. To enhance the density, especially of the liquid impervious layer manufacturing the layer in the form of elements has the advantage, that it is possible to vibrate and/or heat.

The base layer 4 preferably has a high specific gravity, because the particles worked up in it have a high specific gravity, wherewith it is possible that they contain metals, other metal compounds or undesired substances. Also these particles may be bound with a plastic, which may be or not may be the same as is used for layer 3 or layer 1, which each may or may not have another plastic as binding agent. If, however, the particles in layer 4 contain substances, which may not leach toward the soil, it is necessary that the binding agent of layer 4 counters leaching definitively. The layer 3 cannot leach, because it is completely liquid-tight, but leaching of layer 2 is in many cases not completely inadmissible, for instance when water or other liquids oozing through the layer 1 are collected and worked up.

The layer 4 faces a layer 4' of an adjacent pavement element and in practice may be very near to it. The protruding part 5 of the layer 3 is also very near to the protruding part 5' of the layer 3' of the adjacent pavement element. In principle it is in all these cases possible, that liquid from layer 1 passes the outside of layer 3 and penetrates downwardly through the slit between the layers 4 and 4'. To prevent this a sealing of liquid-tight plastic 6 has been applied at the level of the layer 3 or, for instance on top of it if it protrudes beyond layer 1. The shown ridges 5 and 5' may be difficult to manufacture or left out for other reasons. In that instance between the elements joints may be left free or it may be seen to it that layers 3 and 3' protrude somewhat with respect to layers 1. If the plastic 6 adheres completely to the binding agent of layer 3 a very good seal is obtained. A small vertical or horizontal shifting between both pavement elements is absorbed by the elasticity of the sealing mass 6, so that the seal can be warranted in a high degree.

Of course at the border of a floor laid with the shown pavement elements a drainage gutter may be applied, joined with the upper side of layer 3. If now liquids such as petroleum products have been spilled on the pavement elements and possibly later by rain have been washed down, it is very well possible to catch and render harmless the naturally small residues of polluting liquids with means known per se. Such are for instance puts with a discharge below the water surface for catching liquid pollution with a specific gravity, which is smaller than that of water.

The porous layer 2 may contain dyeing particles or fluorescensing or phosphorescensing particles, which for instance before complete curing are deposited and pressed into the surface. This gives a good realisation of the emergency and light marking system of PCT/NL86/00035.

I claim:

1. Pavement element which comprises:

an upper layer consisting of a liquid permeable composition of solid particles and at least one binding agent, a lower, liquid impervious layer connected to the bottom of said upper layer and having an outer perimeter, and a lower layer sealing means associated with at least a portion of the outer perimeter of the lower layer for joining the lower layer of adjacent pavement elements together in a liquid tight manner in order to obtain a unitary liquid impervious layer formed from a plurality of adjacent pavement elements.

2. Pavement element according to claim 1, wherein the lower layer sealing means comprises an extension of the lower layer which facilitates bonding of the sealing means to the lower layer of adjacent pavement elements.

3. Pavement element according to claim 1, wherein the lower layer further comprises at least one protruding ridge along at least a portion of the outer perimeter thereof.

4. Pavement element according to claim 2, wherein the extension is somewhat elastic.

5. Pavement element according to claim 1, wherein the upper layer has a porosity of at least 15 vol. %.

6. Pavement element according to claim 1, wherein the upper layer consists in particles having little difference in size,which particles are bound to each other by a binding agent.

7. Pavement element according to claim 6, wherein the particles have an irregular shape with a largest diameter which is at least twice the smallest diameter.

8. Pavement element according to claim 1, wherein the lower layer contains particles of strongly differing sizes giving a filling degree of more than 90 vol. %.

9. Pavement element according to claim 8, wherein in the upper layer the-interstices between the particles are filled with a binding agent.

10. Pavement element according to claim 9, wherein the binding agent is a plastic which is resistant to petroleum products.

11. Pavement element according to claim 1, wherein below the lower layer a base layer is present with a high specific weight.

12. Pavement element according to claim 11, wherein the base layer particles are composed of one or more materials having a high specific gravity and a distribution of particles sizes, which gives a high filling degree, which particles are bound to each other by a binding agent.

13. Pavement element according to claim 6, wherein the binding agent at least in the lower layer is a non-leaching plastic in a sufficient quantity to envelope the particles.

14. Floor comprising a plurality of pavement elements according to claim 2 wherein a joint above the extension is filled with a sealing composition.

15. Floor according to claim 14, wherein the sealing means is somewhat elastic.

16. Floor comprising a plurality of pavement elements according to claim 1, wherein at least one element selected from sealing rods and a sealing grid is present between at least a portion of the outer perimeters of lower layers of adjacent pavement elements.

17. Method for manufacturing a pavement element which comprises an upper layer consisting of a liquid permeable composition of solid particles and at least one binding agent, a lower, liquid impervious layer connected to the bottom of said upper layer and having an outer perimeter, and a lower layer sealing means associated with at least a portion of the outer perimeter of the lower layer for joining the lower layer of adjacent pavement elements together in a liquid tight manner in order to obtain a unitary liquid impervious lower layer formed from a plurality of adjacent pavement elements; said method comprising the steps of:

moulding each of the upper and lower layers separately, and interconnecting the upper and lower layers.

18. Method in accordance with claim 17 further comprising the steps of interrupting the moulding step before the binding agent of the upper layer is completely cured, laying the upper layer atop the lower layer and completing the curing of the binding agent by polymerization whereby interaction between the binding agent of the upper layer and the lower layer provides at least some of the interconnection of the upper and lower layers.

19. Method in accordance with claim 17 further comprising the step of subjecting at least one of the upper and lower layers in the mould to vibration or compression during the moulding step.

20. Method in accordance with claim 19 wherein the lower layer, and a bottom layer, if present, are subjected to vibration or compression during the moulding step prior to the interconnection of the upper and lower layers.

21. A method for manufacturing a pavement element which comprises an upper layer consisting of a liquid permeable composition of solid particles and at least one binding agent, a lower, liquid impervious layer connected to the bottom of said upper layer and having an outer perimeter, and a lower layer sealing means associated with at least a portion of the outer perimeter of the lower layer for joining the lower layer of adjacent pavement elements together in a liquid tight manner in order to obtain a unitary liquid impervious lower layer formed from a plurality of adjacent pavement elements; said method comprising the steps of:

vibrating a composition of particles of substantially different sizes in a mould together with a non-cured resin and a curing agent to form the lower layer, adding a composition of particles of substantially similar sizes and a curing agent and a non-cured binding agent in a quantity which is considerably less than the quantity required to fill the interstices between the particles of substantially similar sizes atop the composition for forming the lower layer either before, during or after the vibration step, and curing the composition to form the pavement element.

22. Method according to claim 21 further comprising the step of providing a bottom layer of high density material in the mould prior to said vibrating step.

* * * * *